US010314388B2

(12) United States Patent
Rivera

(10) Patent No.: US 10,314,388 B2
(45) Date of Patent: Jun. 11, 2019

(54) ELECTRIC SCRUBBING SYSTEM

(71) Applicant: Jaime Rivera, Waukegan, IL (US)

(72) Inventor: Jaime Rivera, Waukegan, IL (US)

( * ) Notice: Subject to any disclaimer, the term of this patent is extended or adjusted under 35 U.S.C. 154(b) by 157 days.

(21) Appl. No.: 15/367,362

(22) Filed: Dec. 2, 2016

(65) Prior Publication Data

US 2018/0153297 A1 Jun. 7, 2018

(51) Int. Cl.

| | |
|---|---|
| ***A46B 13/00*** | (2006.01) |
| ***A46B 13/02*** | (2006.01) |
| ***A46D 1/00*** | (2006.01) |

(52) U.S. Cl.

CPC ..... *A46B 13/001* (2013.01); *A46B 13/008* (2013.01); *A46B 13/02* (2013.01); *A46D 1/0207* (2013.01); *A46B 2200/3093* (2013.01)

(58) Field of Classification Search

CPC ..... A46B 13/001; A46B 13/02; A46B 13/008; A46D 1/0207

See application file for complete search history.

(56) References Cited

U.S. PATENT DOCUMENTS

| | | | | |
|---|---|---|---|---|
| 2,800,750 | A * | 7/1957 | Field | B24D 9/02 451/507 |
| D292,834 | S | 11/1987 | Slachta | |
| 5,114,231 | A | 5/1992 | Gautherin et al. | |
| 6,295,681 | B1 * | 10/2001 | Dolah | A46B 13/001 15/101 |
| 7,493,670 | B1 | 2/2009 | Brogan | |
| 7,743,683 | B2 | 1/2010 | Dayton et al. | |
| 8,256,056 | B2 | 9/2012 | Jones | |
| 8,479,354 | B1 | 7/2013 | Doyle | |
| 8,752,227 | B2 | 6/2014 | Manning | |
| 8,984,695 | B2 * | 3/2015 | Manning | A47L 13/38 15/144.3 |

FOREIGN PATENT DOCUMENTS

| | | |
|---|---|---|
| EP | 2110043 | 8/2009 |

* cited by examiner

*Primary Examiner* — Shay Karls

(57) ABSTRACT

An electric scrubbing system for using an electric drill to scrub a surface includes an electric drill that is selectively manipulated. A scrubbing unit is provided and the scrubbing unit is removably coupled to the electric drill. The electric drill rotates the scrubbing unit when the electric drill is turned on. The scrubbing unit is comprised of an abrasive material to remove contaminants from a surface.

8 Claims, 4 Drawing Sheets

ELECTRIC SCRUBBING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to scrubbing devices and more particularly pertains to a new scrubbing device for using an electric drill to scrub a surface.

BRIEF SUMMARY OF THE INVENTION

An embodiment of the disclosure meets the needs presented above by generally comprising an electric drill that is selectively manipulated. A scrubbing unit is provided and the scrubbing unit is removably coupled to the electric drill. The electric drill rotates the scrubbing unit when the electric drill is turned on. The scrubbing unit is comprised of an abrasive material to remove contaminants from a surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
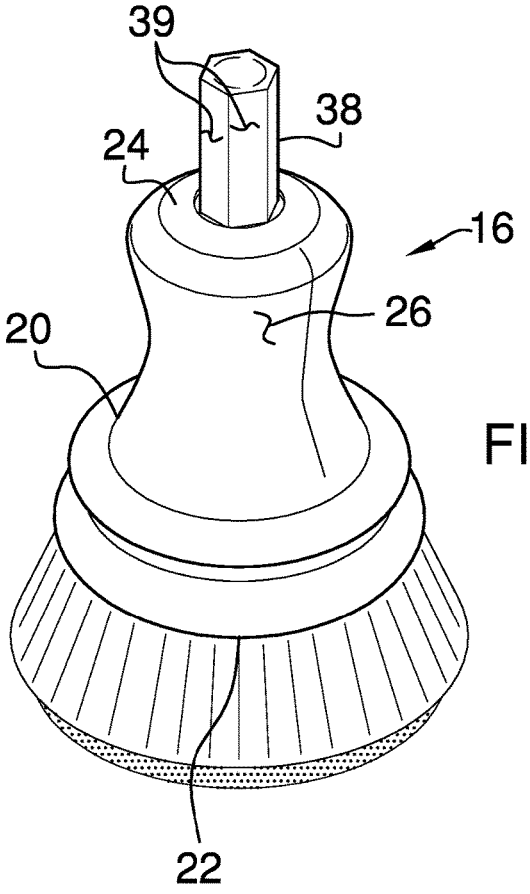
FIG. 1 is a perspective view of a scrubbing unit of an electric scrubbing system according to an embodiment of the disclosure.
Figure 2:
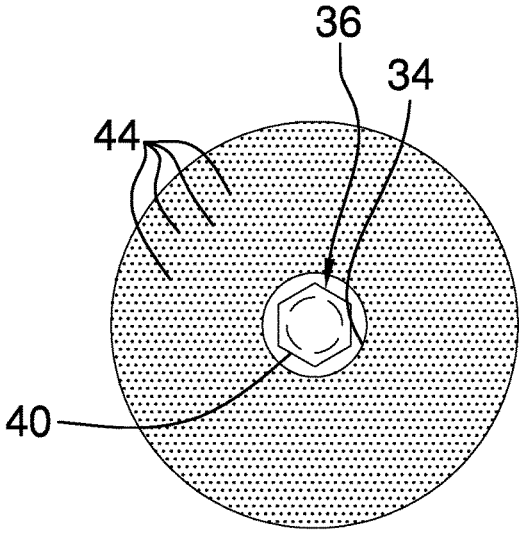
FIG. 2 is a bottom view of a scrubbing unit of an embodiment of the disclosure.
Figure 3:
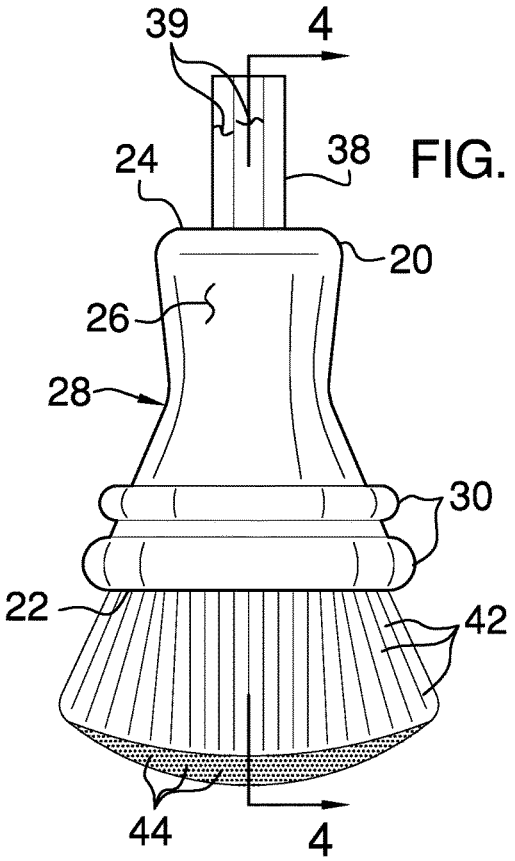
FIG. 3 is a front view of a scrubbing unit of an embodiment of the disclosure.
Figure 4:
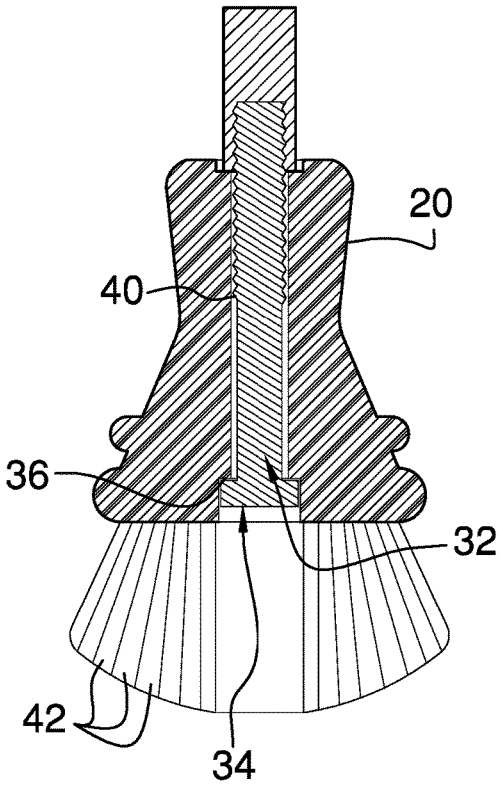
FIG. 4 is a cross sectional view taken along line 4-4 of FIG. 3 of an embodiment of the disclosure.
Figure 5:
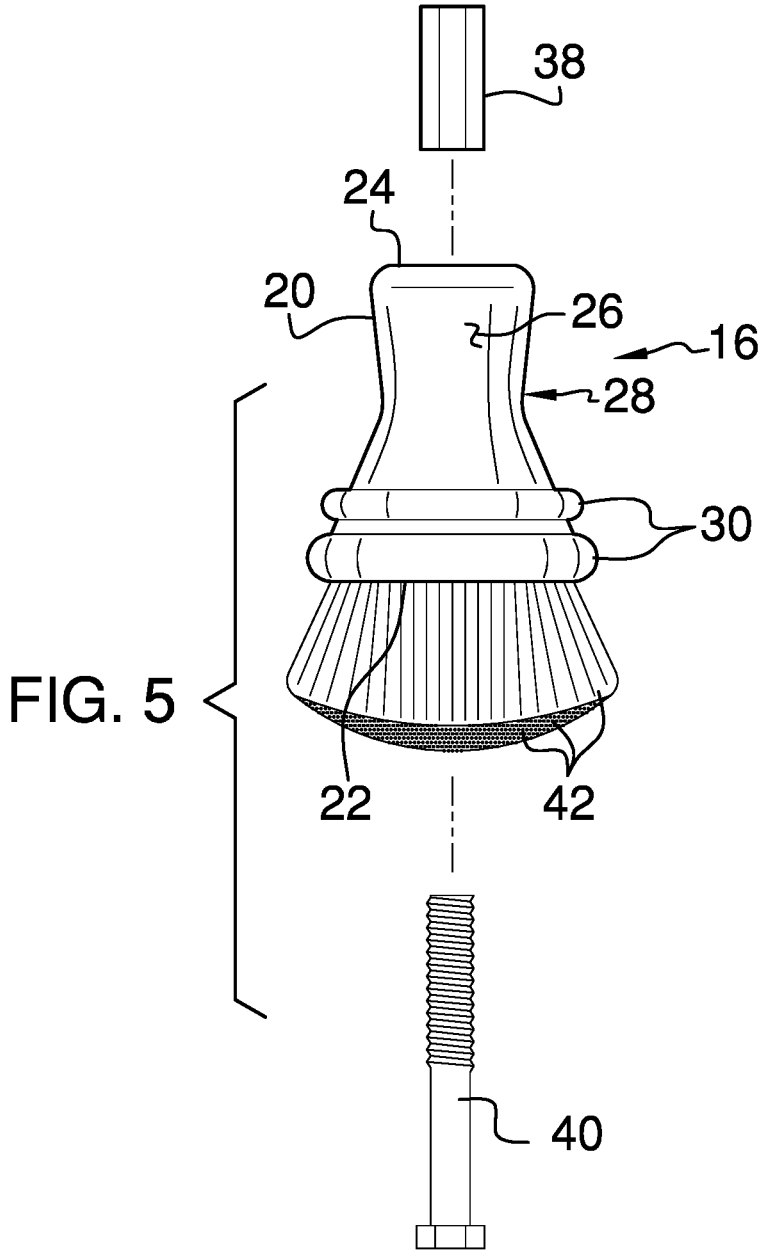
FIG. 5 is an exploded perspective view of a scrubbing unit of an embodiment of the disclosure.
Figure 6:
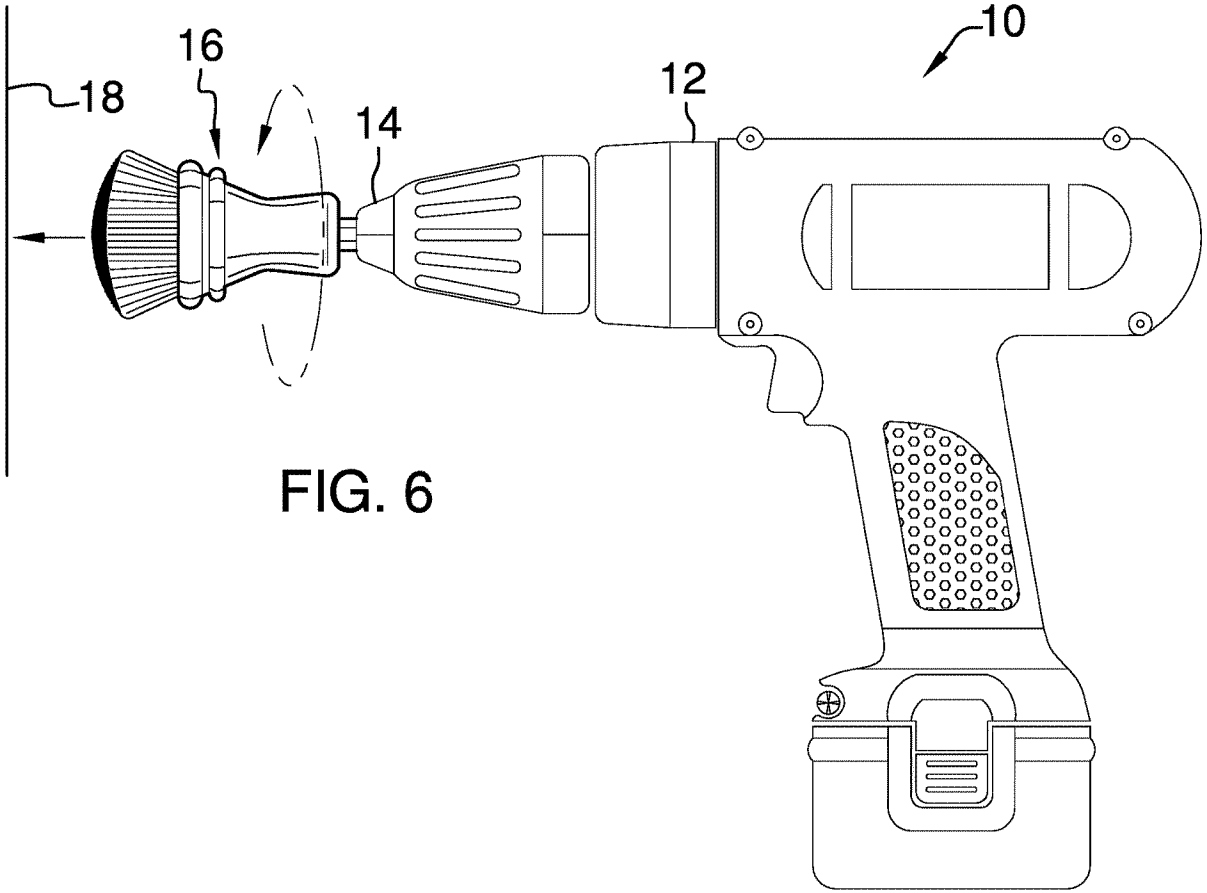
FIG. 6 is a perspective in-use view of an embodiment of the disclosure.

With reference now to the drawings, and in particular to FIGS. 1 through 6 thereof, a new scrubbing device embodying the principles and concepts of an embodiment of the disclosure and generally designated by the reference numeral 10 will be described.

As best illustrated in FIGS. 1 through 6, the electric scrubbing system 10 generally comprises an electric drill 12 that is selectively manipulated and the electric drill 12 has a chuck 14. The electric drill 12 may be an electric drill of any conventional design to include corded drills and cordless drills. A scrubbing unit 16 is provided and the scrubbing unit 16 is removably coupled to the electric drill 12. The electric drill 12 rotates the scrubbing unit 16 when the electric drill 12 is turned on. The scrubbing unit 16 is comprised of an abrasive material to remove contaminants from a surface 18. The surface 18 may be a wall, a floor or other surface and the surface 18 may be comprised of wood, tile, carpet, steel or other material used for construction purposes.

The scrubbing unit 16 comprises a brush 20 that has a first end 22, a second end 24 and an outer surface 26 extending therebetween. The outer surface 26 is continuous such that the brush 20 has a cylindrical shape. The outer surface 26 tapers inwardly between the first end 22 and the second end 24 and the outer surface 26 has a depression 28 near a middle of the brush 20 to enhance gripping the brush 20. A pair of ridges 30 extends outwardly from the outer surface 26 and each of the ridges 30 is continuous to enhance gripping the brush 20.

The brush 20 has an aperture 32 extending through the first end 22 and the second end 24. The first end 22 has a well 34 extending toward the second end 24 and the well 34 is aligned with the aperture 32. The well 34 has a lower bounding surface 36. A sleeve 38 is positioned on the second end 24 of the brush 20 and the sleeve 38 is oriented to be aligned with the aperture 32. The sleeve 38 may be a threaded nut or the like. The sleeve 38 has a plurality of intersecting outer surfaces 39 and the chuck grips the intersecting outer surfaces 39.

A bolt 40 is slidably inserted through the aperture 32 in the brush 20 and the bolt 40 threadably engages the sleeve 38. In this way the sleeve 38 is retained on the brush 20. The bolt 40 engages the lower bounding surface 36 of the well 34 to tighten the sleeve 38 against the brush 20. The sleeve 38 engages the chuck 14 on the electric drill 12 when the sleeve 38 is tightened against the brush 20. Thus, the brush 20 is rotatably coupled to the electric drill 12.

A plurality of bristles 42 is provided and each of the bristles 42 is coupled to and extends away from the first end 22 of the brush 20. The bristles 42 are spaced apart from each other and are distributed on the first end 22. Each of the bristles 42 has a distal end 44 with respect to the brush 20 to frictionally engage the surface 18. Moreover, each of the plurality of bristles 42 has an increasing length with respect to each other between the outer surface 26*d* of the brush 20 and the well 34. Thus, the distal end 44 corresponding to each of the bristles 42 defines a dome.

In use, the bolt 40 is extended through the brush 20 to threadably engage the sleeve 38. The bolt 40 is tightened and the sleeve 38 is tightened against the brush 20. The sleeve 38 is inserted into the chuck 14 on the electric drill 12. The electric drill 12 is manipulated to position the bristles 42 against the surface 18. The electric drill 12 is turned on and the brush 20 abrades the contaminants from the surface 18. In this way the brush 20 cleans the surface 18.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electric scrubbing system comprising:

an electric drill being configured to be manipulated;

a scrubbing unit being removably coupled to said electric drill such that said electric drill rotates said scrubbing unit when said electric drill is turned on, said scrubbing unit being comprised of an abrasive material wherein said scrubbing unit is configured to remove contaminants from a surface, said scrubbing unit comprising a brush having a first end, a second end and an outer surface extending therebetween, said outer surface being continuous such that said brush has a cylindrical shape, said outer surface tapering inwardly between said first end and said second end;

a plurality of bristles, each of said bristles being coupled to and extending away from said first end of said brush, said bristles being spaced apart from each other and being distributed on said first end, each of said bristles having a distal end with respect to said brush wherein said distal end is configured to frictionally engage the surface; and a pair of ridges extending outwardly from said outer surface, one of said pair of ridges being positioned at said first end adjacent to said bristles, said pair of ridges being parallel to each other wherein said pair of ridges is configured to enhance gripping of said brush, said one of said ridges adjacent to said bristles having a circumference greater than a circumference of another one of said pair of ridges.

2. The system according to claim 1, wherein said brush has an aperture extending through said first end and said second end.

3. The system according to claim 2, wherein said first end has a well extending toward said second end, said well being aligned with said aperture, said well having a lower bounding surface.

4. The system according to claim 3, further comprising:

a sleeve; and a bolt being slidably inserted through said aperture in said brush, said bolt threadably engaging said sleeve such that said sleeve is retained on said brush, said bolt engaging said lower bounding surface of said well such that said sleeve is tightened against said brush.

5. The system according to claim 4, wherein:

said electric drill has a chuck; and said sleeve engaging said chuck on said electric drill when said sleeve is tightened against said brush such that said brush is rotatably coupled to said electric drill.

6. The system according to claim 2, further comprising a sleeve being positioned on said second end of said brush, said sleeve being aligned with said aperture.

7. The system according to claim 1, further comprising each of said plurality of bristles having an increasing length with respect to each other between said outer surface of said brush and said well such that said distal end corresponding to each of said bristles defines a dome.

8. An electric scrubbing system comprising:

an electric drill being configured to be manipulated, said electric drill having a chuck; and a scrubbing unit being removably coupled to said electric drill such that said electric drill rotates said scrubbing unit when said electric drill is turned on, said scrubbing unit being comprised of an abrasive material wherein said scrubbing unit is configured to remove contaminants from a surface, said scrubbing unit comprising:

a brush having a first end, a second end and an outer surface extending therebetween, said outer surface being continuous such that said brush has a cylindrical shape, said outer surface tapering inwardly between said first end and said second end, said brush having an aperture extending through said first end and said second end, said first end having a well extending toward said second end, said well being aligned with said aperture, said well having a lower bounding surface, a sleeve being positioned on said second end of said brush, said sleeve being aligned with said aperture, a bolt being slidably inserted through said aperture in said brush, said bolt threadably engaging said sleeve such that said sleeve is retained on said brush, said bolt engaging said lower bounding surface of said well such that said sleeve is tightened against said brush, said sleeve engaging said chuck on said electric drill when said sleeve is tightened against said brush such that said brush is rotatably coupled to said electric drill, a plurality of bristles, each of said bristles being coupled to and extending away from said first end of said brush, said bristles being spaced apart from each other and being distributed on said first end, each of said bristles having a distal end with respect to said brush wherein said distal end is configured to frictionally engage the surface, each of said plurality of bristles having an increasing length with respect to each other between said outer surfaced of said brush and said well such that said distal end corresponding to each of said bristles defines a dome, and a pair of ridges extending outwardly from said outer surface, one of said pair of ridges being positioned at said first end adjacent to said bristles, said pair of ridges being parallel to each other wherein said pair of ridges is configured to enhance gripping of said brush, said one of said ridges adjacent to said bristles having a circumference greater than a circumference of another one of said pair of ridges.

* * * * *